United States Patent [19]

Folkins

[11] Patent Number: 4,565,438

[45] Date of Patent: Jan. 21, 1986

[54] DEVELOPMENT SYSTEM USING ELECTRICALLY FIELD DEPENDENT DEVELOPER MATERIAL

[75] Inventor: Jeffrey J. Folkins, Rochester, N.Y.

[73] Assignee: Xerox Corporation, Stamford, Conn.

[21] Appl. No.: 575,967

[22] Filed: Feb. 1, 1984

[51] Int. Cl.[4] ..... G03G 15/09

[52] U.S. Cl. ..... 355/3 DD; 355/14 D; 118/658

[58] Field of Search ..... 355/3 DD, 14 D; 118/647, 648, 651, 658, 653; 430/120

[56] References Cited

U.S. PATENT DOCUMENTS

| | | | |
|---|---|---|---|
| 3,599,605 | 8/1971 | Ralston et al. . | |
| 3,914,771 | 10/1975 | Lunde et al. . | |
| 4,076,857 | 2/1978 | Kasper et al. . | |
| 4,102,305 | 7/1978 | Schwarz | 118/651 |
| 4,267,797 | 5/1981 | Huggins | 118/658 |
| 4,279,942 | 7/1981 | Swapceinski | 118/651 |
| 4,343,548 | 8/1982 | Bares et al. | 355/3 DD |
| 4,385,823 | 5/1983 | Kasper et al. | 355/3 DD X |
| 4,391,891 | 7/1983 | Tamura et al. | 430/120 |
| 4,466,732 | 8/1984 | Folkins | 355/14 D |

*Primary Examiner*—A. T. Grimley
*Assistant Examiner*—J. Pendegrass
*Attorney, Agent, or Firm*—H. Fleischer; J. E. Beck; R. Zibelli

[57] ABSTRACT

An apparatus in which an image region recorded on a photoconductive surface is developed with a developer material comprising at least carrier granules and toner particles. The developer material has the resistivity thereof varying continuously as a function of the electrical field applied thereto. A transport moves the developer material closely adjacent to the photoconductive surface. An alternating electrical field is generated between the transport and the photoconductive surface. The alternating electrical field has an amplitude sufficient to change the resistivity of the developer material to a more conductive state.

14 Claims, 8 Drawing Figures

DEVELOPMENT SYSTEM USING ELECTRICALLY FIELD DEPENDENT DEVELOPER MATERIAL

This invention relates generally to an electrophotographic printing machine, and more particularly concerns an apparatus for developing a latent image.

Generally, an electrophotographic printing machine includes a photoconductive member which is charged to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After recording the electrostatic latent image on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Frequently, the developer material is made from a mixture of at least carrier granules and toner particles. The toner particles adhere triboelectrically to the carrier granules. This mixture is brought into contact with the latent image. Toner particles are attracted from the carrier granules to the latent image forming a toner powder image thereon. Hereinbefore, it has been difficult to develop both the large solid areas and fine lines of the latent image. Generally speaking, it has been found that an insulating developer material optimumly develops fine lines in the latent image because of the fringe fields associated with such lines. However, an insulating developer material does not optimumly develop solid areas in the latent image. Alternatively, conductive developer materials have been found to optimumly develop solid areas of the latent image while poorly developing lines contained therein. Thus, it is highly desirable to be capable of varying the resistivity of the developer material. Hence, to develop lines in the latent image, the developer material should be insulative, while when developing solid areas, the developer material should be conductive. In this way, both the lines and solid areas in the latent image may be optimumly developed. Hereinbefore, magnetic brush developer rollers have been electrically biased. The electrical bias is generally a constant value. Modulation of the developer material is in a fixed, discrete manner. In this way, a parameter of the development system is modified.

Various approaches have been devised to improve development, the following disclosures appear to be relevant:

U.S. Pat. No. 3,599,605
Patentee: Ralston et al.
Issued: Aug. 17, 1971
U.S. Pat. No. 3,914,771
Patentee: Lunde et al.
Issued: Oct. 21, 1975
U.S. Pat. No. 4,076,857
Patentee: Kasper et al.
Issued: Feb. 4, 1978
U.S. Pat. No. 4,102,305
Patentee: Schwarz
Issued: July 25, 1978 co-pending U.S. application Ser. No. 387,062
Applicant: Savage
Filed: June 10, 1982
co-pending U.S. application Ser. No. 392,964
Applicant: Folkins
Filed: June 28, 1984

The pertinent portions of the foregoing disclosures may be briefly summarized as follows:

Ralston et al. describes a self-biasing electrode system for development of an electrostatic latent image. The developer mixture contains, in addition to the toner particles, carrier particles which are ferromagnetic and probably conductive. A magnetic brush developer unit having a rotating steel cylinder is positioned adjacent the photoconductive surface. A variable resistor or a resistor and capacitor are arranged in parallel with one another to connect the cylinder to an electrical ground. The charge on the photoconductor induces a charge on the cylinder. The electrical circuit retards the flow of charge from the cylinder and has the effect of maintaining the cylinder at a potential above ground during the time that the electrostatic latent image is being developed. The circuit also allows a portion of the charge to bleed off so that the cylinder is at a potential less than the potential that would accumulate on the cylinder if it was allowed to float. Ralston et al. states that when the resistance is at infinity, almost no image can be developed on the photoconductor by the toner particles. The magnitude of the induced charge is such that if the cylinder is allowed to electrically float, i.e. be electrically insulated from its surroundings, then the charge will build up to the point where sufficient toner particles will not be attracted away from the carrier and cylinder to the electrostatic latent image recorded on the photoconductive surface.

Lunde et al. discloses a developer roller having a non-magnetic outer cylindrical shell telescoped over a magnetic roller. An electronically conducting toner is metered onto the surface of the shell. A pulse control circuit is coupled to the shell and applies a voltage pulse when one of the magnetic sectors of the roller is in an optimum position for development.

Kasper et al. describes a development system using a developer material which undergoes electrical breakdown. The developer roller is electrically biased to a sufficient magnitude to abruptly change the developer material from being insulative to being conductive.

Schwarz describes a developer roller which is electrically biased by a constant electrical voltage having an alternating electrical voltage superimposed thereover. The peak amplitude of the alternating voltage is sufficient to render a developer material which has the resistivity thereof varying as a function of the electrical field applied thereto substantially conductive. In Schwarz, the developer material disclosed is a single component developer material. Thus, the developer material comprises toner particles, i.e. carrier granules are not used.

Savage describes a development system employing a developer roller which is electrically insulated from an electrical ground. The charge on the photoconductive surface induces a charge on the developer roller that biases the developer roller to a potential intermediate the potential of the image region and non-image regions recorded on the photoconductive surface.

Folkins discloses a development system in which the charge on the photoconductive surface induces a charge on the developer roller that biases the developer roller to a potential intermediate the potential of the image region and non-image regions recorded on the photoconductive surface. An electrical circuit coupled to the developer bounds the upper and lower limits of the bias on the developer roller.

In accordance with one aspect of the present invention, there is provided an apparatus for developing an image region recorded on a photoconductive surface with a developer material comprising at least carrier granules and toner particles. The developer material has the resistivity thereof varying as a function of the electrical field applied thereto. Means transport the developer material closely adjacent to the photoconductive surface so that the toner particles are attracted from the carrier granules to the image region forming a toner powder image thereon. Means are provided for generating an alternating electrical field between the transporting means and the photoconductive surface. The alternating electrical field has an amplitude sufficient to change the resistivity of the developer material to a more conductive state.

Pursuant to another aspect of the present invention, there is provided an electrophotographic printing machine of the type having an electrostatic latent image and a background region regarded on a photoconductive surface. The latent image is developed by a developer material comprising at least carrier granules and toner particles. The resistivity of the developer material varies as a function of the electrical field applied thereto. Means transport the developer material closely adjacent to the photoconductive surface so that the toner particles are attracted from the carrier granules to the latent image forming a toner powder image thereon. Means are provided for generating an alternating electrical field between the transporting means and the photoconductive surface. The alternating electrical field has an amplitude sufficient to change the resistivity of the developer material to a more conductive state.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
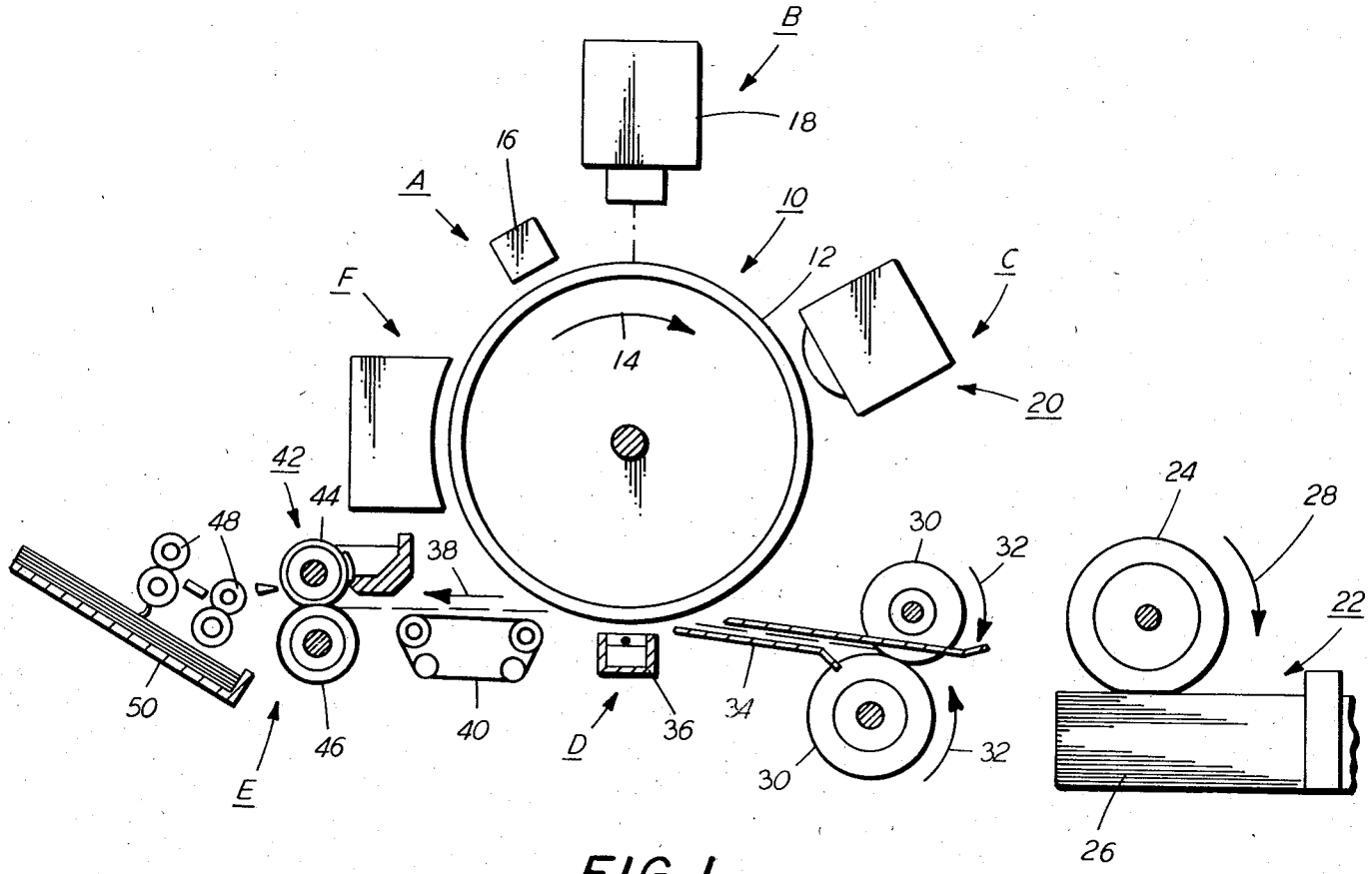
FIG. 1 is a schematic elevational view depicting an electrophotographic printing machine incorporating the features of the present invention therein.

As shown in FIG. 1, the illustrative electrophotographic printing machine employs a drum 10 having a photoconductive surface 12. Preferably, photoconductive surface 12 comprises a selenium alloy adhering to a conductive substrate, e.g. an electrically grounded aluminum alloy. Drum 10 moves in the direction of arrow 14 to advance photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential.

Next, the charged portion of photoconductive surface 12 is advanced through exposure station B. Exposure station B includes an exposure system, indicated generally by the reference numeral 18. At exposure system 18, a light source illuminates an original document positioned facedown upon a transparent platen. Light rays reflected from the original document are transmitted through a lens to form a light image thereof. The light image is focused on the charged portion of photoconductive surface 12 to selectively dissipate the charge thereon. This records an electrostatic latent image on photoconductive surface 12 which corresponds to the informational areas contained within the original document. One skilled in the art will appreciate that in lieu of the foregoing optical system a modulated beam of energy, i.e. a laser beam, may irradiate the charged portion of the photoconductive surface to record selected information thereon. The information from the computer is employed to modulate the laser beam.

After the electrostatic latent image is recorded on photoconductive surface 12, drum 10 advances the latent image to development station C. At development station C, a magnetic brush development system, indicated generally by the reference numeral 20, advances a developer material comprising at least carrier granules and toner particles into contact with the electrostatic latent image. When an electrical field is not present, the developer material is normally insulative. The conductivity of the developer material, in the absence of an electrical field, is generally less than $10^{-11}$ (ohm-cm)$^{-1}$. The latent image attracts the toner particles from the carrier granules of the developer material to form a toner powder image on photoconductive surface 12 of drum 10. The detailed structure of development system 20 will be described hereinafter with reference to FIGS. 2 and 3.

Drum 10 then advances the toner powder image adhering to photoconductive surface 12 to transfer station D. At transfer station D, a sheet of support material is moved into contact with the powder image. The sheet of support material is advanced to transfer station D by a sheet feeding apparatus, indicated generally by the reference numeral 22. Preferably, sheet feeding apparatus 22 includes a feed roll 24 contacting the uppermost sheet of a stack of sheets 26. Feed roller 24 rotates in the direction of arrow 28 to advance the uppermost sheet into the nip defined by forwarding rollers 30. Forwarding rollers 30 rotate in the direction of arrow 32 to advance the sheet into chute 34. Chute 34 directs the advancing sheet of support material into contact with photoconductive surface 12 of drum 10 so that the toner powder image developed thereon contacts the advancing sheet at transfer station D.

Preferably, transfer station D includes a corona generating device 36 which sprays ions onto the backside of the sheet. This attracts the toner powder image from photoconductive surface 12 to the sheet. After transfer, the sheet continues to move in the direction of arrow 38 onto conveyor 40 which advances the sheet to fusing station E.

Fusing station E includes a fuser assembly, indicated generally by the reference numeral 42, which permanently affixes the transferred toner powder image to the sheet. Preferably, fuser assembly 42 includes a heated fuser roller 44 and a back-up roller 46. The sheet passes between fuser roller 44 and back-up roller 46 with the toner powder image contacting fuser roller 44. In this manner, the toner powder image is permanently affixed to the sheet. After fusing, forwarding rollers 48 advance the sheet to catch tray 50 for removal from the printing machine by the operator.

Invariably, after the sheet of support material is separated from photoconductive surface 12 of drum 10 some residual particles remain adhering thereto. These residual particles are removed from photoconductive surface 12 at cleaning station F. Preferably, cleaning station F includes a rotatably mounted brush in contact with photoconductive surface 12. The particles are cleaned from photoconductive surface 12 by the rotation of the brush in contact therewith. Subsequent to cleaning, a discharge lamp floods phitoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
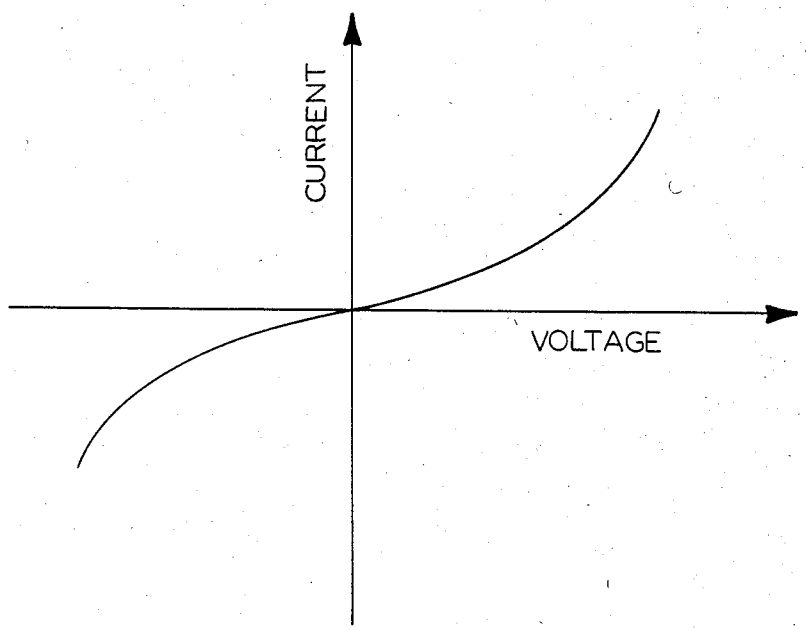
FIG. 2 is an exemplary graph showing a plot of the developer material electrical characteristics.

Referring now to FIG. 2, there is shown a graph illustrating the electrical characteristics of the developer material. As shown thereat, the developer material has a non-ohmic current-voltage characteristic such that the electrical conductivity increases with the applied electrical field.

Figure 3:
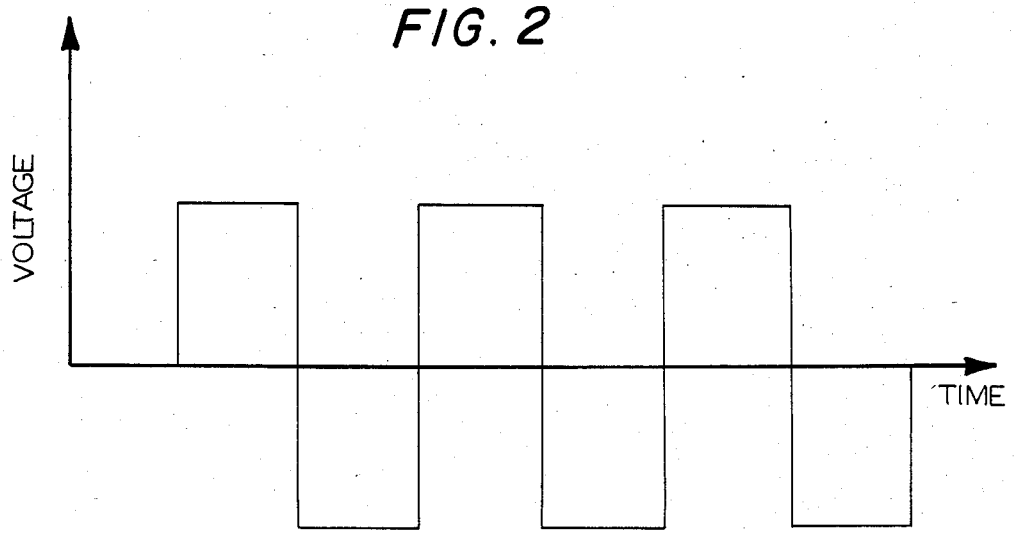
FIG. 3 is an exemplary graph illustrating the symmetrical alternating electrical bias on the developer roller of the development system.

Turning now to FIG. 3, the voltage source electrically biasing the developer roller is a symmetrical square wave. The amplitude of the square wave is greater than the minimum voltage required to cause the developer material to become conductive. Hence, the impressed electrical field across the brush of developer material is significantly increased for any instant of time. However, the average field, integrated over one time period, remains unchanged. Inasmuch as the developer material has a non-ohmic current-voltage characteristic, the increased instantaneous electrical field applied across the brush of developer material will result in an apparent higher conductivity.

Figure 4:
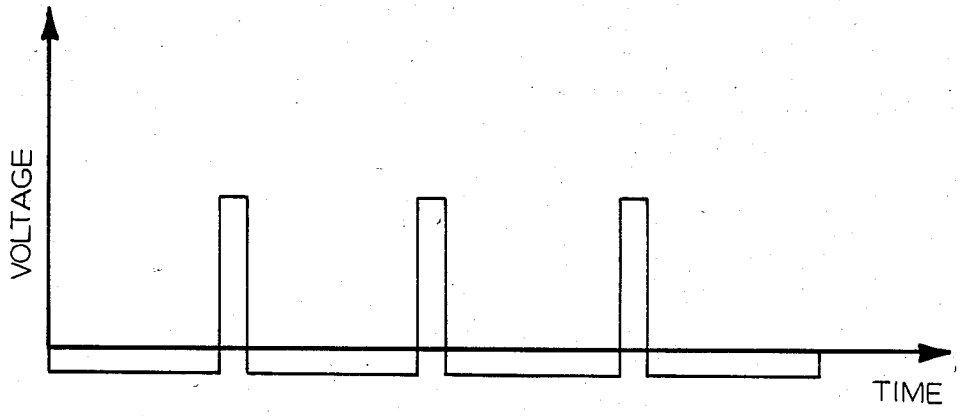
FIG. 4 is an exemplary graph illustrating the asymmetrical alternating electrical bias on the developer roller of the development system.

Alternatively, as shown in FIG. 4, the voltage source electrically biasing the developer roller may be an asymmetrical square wave. When an asymmetrical square wave is used, the increase in conductivity described for the symmetrical square wave remains the same. However, there is the additional effect of a build up of charge of the ends of the brush of developer material adjacent the photoconductive surface. This charge build up causes an additional effective DC field to be superimposed over any other DC field applied to the developer roller. The polarity and direction of this field are determined by the exact shape of the asymmetric square wave. The fields created by the charge build up are unique in that they cannot be formed by the application of normal DC fields.

Figure 5:
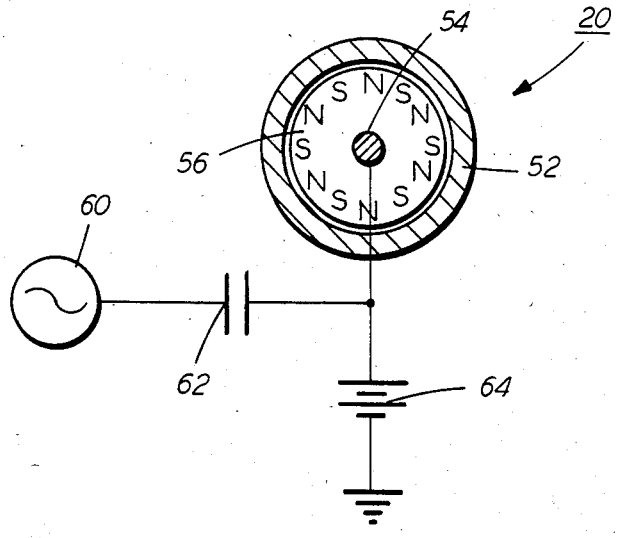
FIG. 5 shows one embodiment of the development system used in the FIG. 1 printing machine.

Referring now to FIG. 5, there is shown the detailed structure of one embodiment of the development system 20 used in the electrophotographic printing machine depicted in FIG. 1. FIG. 5 depicts schematically development system 20 as including a tubular roll 52 mounted rotatably on a shaft 54. An elongated magnetic cylinder 56 is disposed interiorly of tubular roll 52 and spaced from the interior circumferential surface thereof. Magnet 56 has a plurality of magnetic poles impressed thereon. Preferably, tubular roll 52 is made from aluminum with magnetic 56 being made from barium ferrite. Magnet 56 is mounted stationarily. As tubular roll 52 rotates, the developer material is transported closely adjacent to photoconductive surface 12. In the development zone, the electrostatic latent image attracts the toner particles from the carrier granules. A voltage source 60, coupled to a capacitor 62, applies an alternating voltage on tubular roll 52. The peak amplitude of the voltage is sufficient to render the developer material effectively conductive. The voltage electrically biasing tubular roll 52 may range from 50 volts rms to 1000 volts rms at a frequency ranging from 500 hertz to about 20,000 hertz. Preferably, voltage source 60 electrically biases tubular member 52 with a symmetrical square wave (FIG. 3). However, an asymmetrical square wave (FIG. 4), a sine wave, or any other suitable alternating voltage may be utilized. Voltage source 64 is coupled to tubular member 52 and applies a constant DC potential thereon. Voltage source 64 may have an inductive element in series therewith so as to prevent any cross-coupling from voltage source 60.

Figure 6:
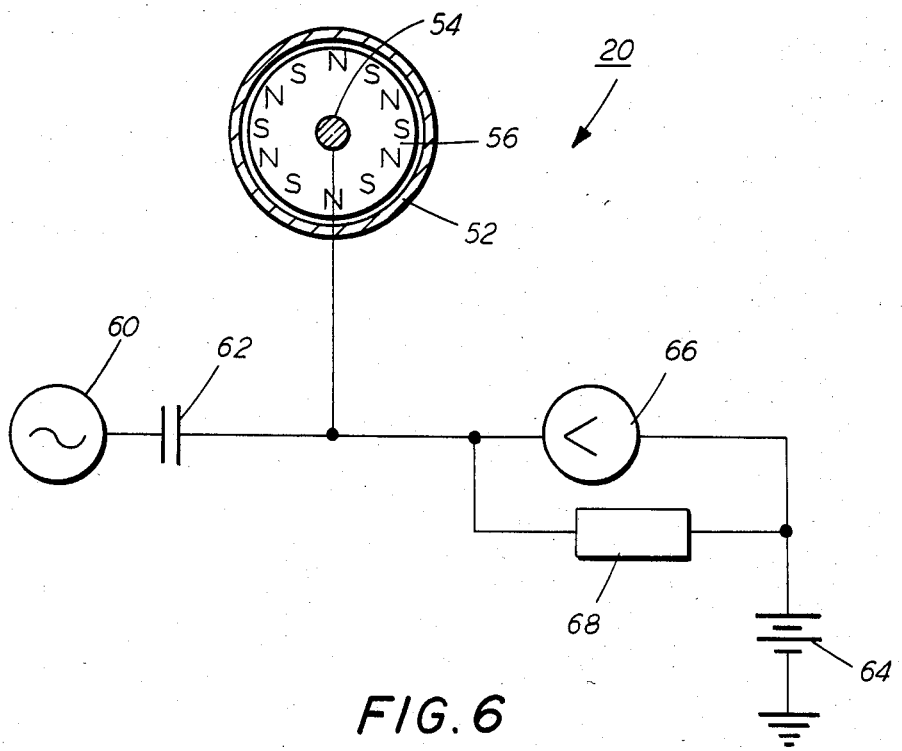
FIG. 6 illustrates another embodiment of the development system used in the FIG. 1 printing machine.

Turning now to FIG. 6, there is shown another embodiment of development system 20. As depicted thereat, voltage source 60 is coupled to tubular member 52 through capacitor 62 to apply an alternating voltage thereon. Voltage source 64 generates a constant DC voltage which electrically biases tubular member 52 in combination with current source 66 and Zener diode 68. Current source 66 may be made with a voltage source and a resistor. Zener diode 68 and current source 66 limit the upper and lower potentials applied to tubular member 52. Alternatively, voltage source 64 may be removed and the constant DC bias applied on tubular member 52 allowed to electrically float. The charge on the photoconductive surface passing through the development zone, as well as any triboelectric charging of the brush of developer material on the photoconductive surface, induces the charge on tubular roll 52. The induced charge is a constant with the magnitude thereof varying. The magnitude of this induced charge is sufficient to build up a charge on tubular roll 52 which electrically biased tubular roll 52 to constant level intermediate that of the background non-image regions recorded on photoconductive surface 12 and that of the image regions, i.e. the electrostatic latent image. In this way, a constant electrical bias is induced on tubular roll 52 which floats and depends upon the charge on the photoconductive surface.

Figure 7:
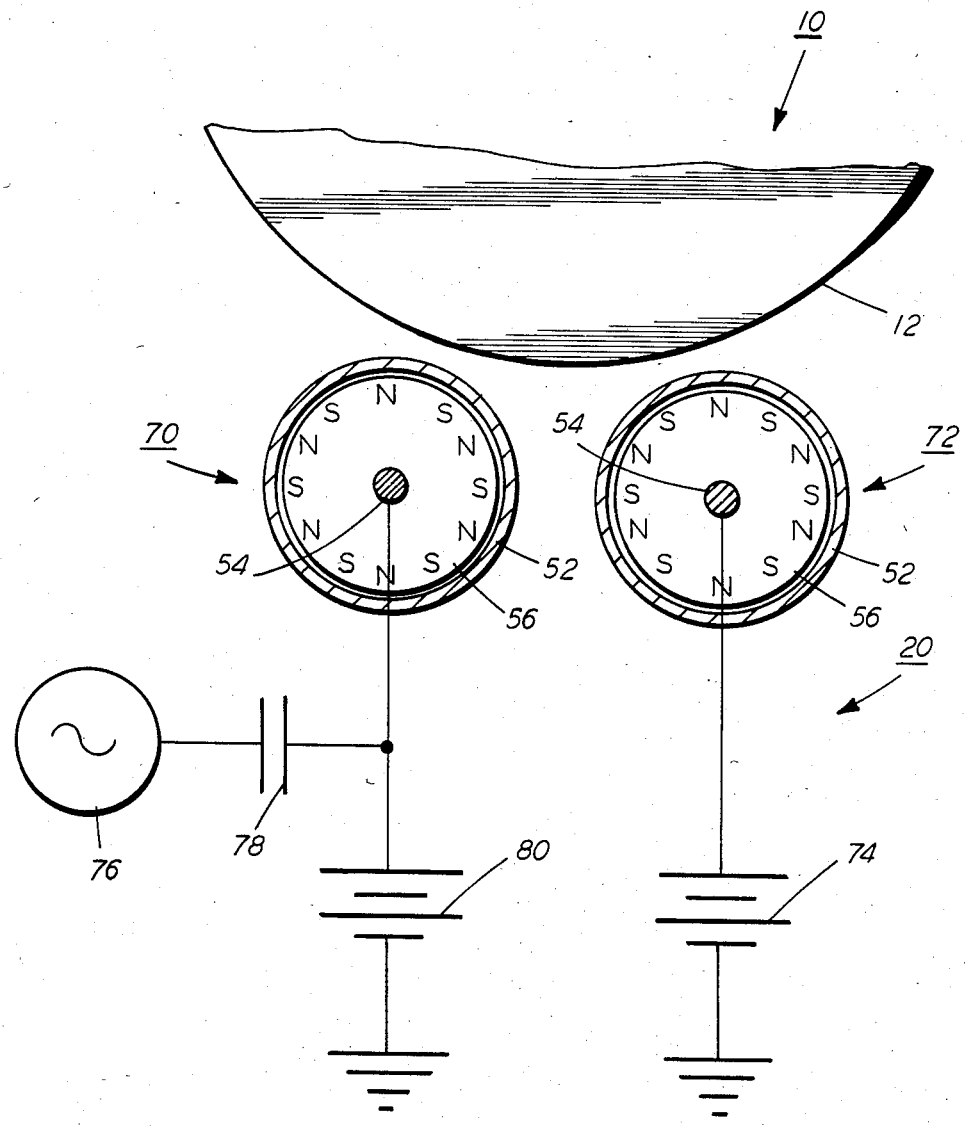
FIG. 7 depicts another embodiment of the development system used in the FIG. 1 printing machine.

Turning now to FIG. 7, there is illustrated another embodiment of development system 20. The development system 20 shown in FIG. 7 is a hybrid system employing two developer rollers, indicated generally by the reference numerals 70 and 72. Each of the developer rollers has a tubular member 52 mounted rotatably on a shaft 54. A stationary magnet 56 is mounted interiorly of tubular member 52. One developer roller 72 is electrically biased by a constant DC source 74. This developer roller optimizes development of lines in the electrostatic latent image. The other developer roller 70 has an AC electrical bias applied to tubular member 52 in addition to a constant DC voltage applied thereon by AC voltage source 76 coupled to capacitor 78 and DC voltage source 80. This latter developer roller optimumly develops solid areas in the latent image. In this way, the development system employing two developer rollers would require only one developer material and developer material housing, i.e. a normally insulative developer material, which would be employed by one developer roller to optimumly develop lines in the latent image, and which would be rendered substantially conductive by the other developer roller so as to optimumly develop solid areas therein. In this way, the hybrid development system utilizes a common developer material for each roll with one roller rendering the normally insulative developer material substantially conductive. Thus, the development system develops both the lines and solid areas in the latent image in an optimum fashion.

Figure 8:
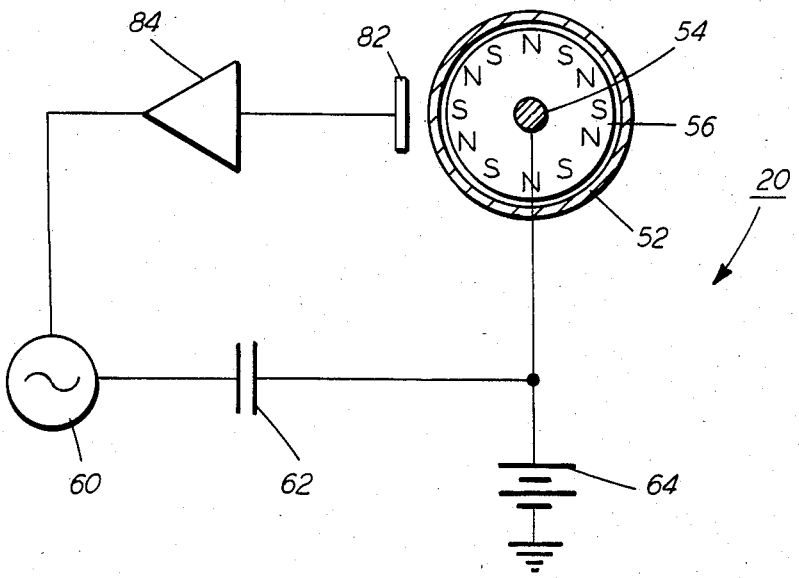
FIG. 8 depicts still another embodiment of the development system used in the FIG. 1 printing machine.

In all of the foregoing systems, the magnitude of the applied voltage on the developer roller may be continuously adjustable so as to provide for continuously variable amounts of developer material conductivity. This permits continous adjustment of the developed image characteristics. The adjustment may be operator controllable or, controlled by the printing machine logic in accordance with a stored algorithm. A closed loop system may be used to control developer material conductivity. A development system 20 of this type is illustrated in FIG. 8. As shown thereat, a conductivity sensor 82 is spaced from tubular member 52 with developer material filling the space therebetween. Conductivity sensor 82 may include a conductive plate. A voltage is applied to the plate of sensor 82 with the resultant current being a measure of the developer material conductivity. Alternatively, a current may be applied to the plate of sensor 82 with the resultant voltage being a measure of the developer material conductivity. Thus, an electrical signal is generated by sensor 82 indicative of the developer material conductivity. Feedback amplifier 84 couples sensor 82 to alternating voltage source 60. This controls the alternating bias applied by voltage source 60 and capacitor 62 on tubular member 52 so as to regulate the developer material conductivity. The alternating electrical bias on tubular member 52 is superimposed over a constant DC electrical bias applied thereon by voltage source 64.

In operation, drum 10 rotates so that the latent image recorded on photoconductive surface 12 passes through the development zone. The developer material comprising carrier granules having toner particles adhering triboelectrically thereto are attracted to the developer roller and advance therewith into the development zone. The brush-like fibers of developer material extended outwardly from the developer roller and contact the electrostatic latent image in the development zone. The surface of the developer roller in the development zone, i.e. in close proximity to the photoconductive surface acts as a development electrode. An alternating voltage electrically biases the developer roller. The time constant for the electrical charge to flow up or down the brush of developer material is smaller then the duration of time that the electrostatic latent image spends in the development zone. In this way, the developer material becomes effectively conductive. Thus, the effective development electrode above the electrostatic latent image is reduced to only a few microns. The developer material is rendered effectively conductive by the alternating electrical voltage.

In recapitulation, it is clear that the development apparatus of the present invention can continuously vary the conductivity of the developer material. This enables various embodiments of the development system of the present invention to be employed depending upon the desired system characteristics. In one embodiment, an alternating voltage is superimposed over a constant DC voltage. Alternatively, the DC voltage may be electrically floating with the DC voltage level being a function of the charge on the photoconductive surface. The upper and lower limits of the DC voltage may be bounded. In multi-roll systems, one developer roller may have an alternating voltage applied thereon with the other developer roller only having a constant DC bias applied thereon. A hybrid system of this type optimumly develops both lines and solid areas in the electrostatic latent image recorded on the photoconductive surface.

It is, therefore, evident that there has been provided in accordance with the present invention, an apparatus for developing an electrostatic latent image that improves development of solid areas and lines. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for developing an image region recorded on a photoconductive surface with a developer material comprising at least carrier granules and toner particles and the developer material having the resistivity thereof varying continuously as a function of the electrical field applied thereto, including:

first means for transporting the developer material closely adjacent to the photoconductive surface so that the toner particles are attracted from the carrier granules to the image region forming a toner powder image thereon;

means for generating an alternating electrical field between said first transporting means and the photoconductive surface with the alternating field having an amplitude sufficient to change the resistivity of the developer material to a more conductive state; and means for sensing the conductivity of the developer material and controlling the alternating electrical field generated by said generating means.

2. An apparatus according to claim 1, further including means for generating a constant electrical field between said first transporting means and the photoconductive surface with the alternating electrical field being superimposed thereover.

3. An apparatus for developing an image region recorded on a photoconductive surface with a developer material comprising at least carrier granules and toner particles and the developer material having the resistivity thereof varying continuously as a function of the electrical field applied thereto, including:

first means for transporting the developer material closely adjacent to the photoconductive surface so that the toner particles are attracted from the carrier granules to the image region forming a toner powder image thereon, said first transporting means comprising a first magnetic member and a first non-magnetic tubular member having said first magnetic member disposed interiorly thereof and spaced therefrom, said first tubular member and said first magnetic member having a relative angular velocity with respect to one another to advance the developer material closely adjacent to the photoconductive surface;

means generating an alternating electrical field between said first transporting means and the photoconductive surface with the alternating field having an amplitude sufficient to change the resistivity of the developer material to a more conductive state;

means for generating a constant electrical field between said first transporting means and the photoconductive surface with the alternating electrical field being superimposed thereover; and means for sensing the conductivity of the developer material and controlling the alternating electrical field generated by said generating means.

4. An apparatus according to claim 3, further including second means, spaced from said first transporing means, for transporting the developer material closely adjacent to the photoconductive surface so that the toner particles are attracted from the carrier granules to the image region forming a toner powder image thereon.

5. An apparatus according to claim 4, wherein said second transporting means includes:

a second magnetic member; and a second non-magnetic tubular member.

6. An apparatus according to claim 3, wherein the charge on the photoconductive surface induces a charge on said first transporting means that biases said first transporting means to a floating constant electrical bias.

7. An apparatus according to claim 6, further including means for limiting the upper and lower values of the constant electrical bias applied on said first transporting means.

8. An electrophotographic printing machine of the type having an electrostatic latent image and a background region recorded on a photoconductive surface with the latent image being developed by a developer material comprising at least carrier granules and toner particles with the resistivity of the developer material varying continuously as a function of the electrical field applied thereto, wherein the improvement includes:

first means for transporting the developer material closely adjacent to the photoconductive surface so that the toner particles are attracted from the carrier granules to the latent image forming a toner powder image thereon;

means for generating an alternating electrical field between said first transporting means and the photoconductive surface with the alternating field having an amplitude sufficient to change the resistivity of the developer material to a more conductive state; and means for sensing the conductivity of the developer material and controlling the alternating electrical field generated by said generating means.

9. A printing machine according to claim 8, further including means for generating a constant electrical field between said first transporting means and the photoconductive surface with the alternating electrical field being superimposed thereover.

10. An electrophotographic printing machine of the type having an electrostatic latent image and a background region recorded on a photoconductive surface with the latent image being developed by a developer material comprising at least carrier granules and toner particles with the resistivity of the developer material varying continuously as a function of the electrical field applied thereto, wherein the improvement includes:

first means for transporting the developer material closely adjacent to the photoconductive surface so that the toner particles are attracted from the carrier granules to the latent image forming a toner powder image thereon, said first transporting means comprising a first magnetic member and a first non-magnetic tubular member having said first magnetic member disposed interiorly thereof and spaced therefrom, said first tubular member and said first magnetic member having a relative angular velocity with respect to one another to advance the developer material closely adjacent to the photoconductive surface;

means for generating an alternating electrical field between said first transporting means and the photoconductive surface with the alternating field having an amplitude sufficient to change the resistivity of the developer material to a more conductive state;

means for generating a constant electrical field between said first transporting means and the photoconductive surface with the alternating electrical field being superimposed thereover; and means for sensing the conductivity of the developer material and controlling the alternating electrical field generated by said generating means.

11. A printing machine according to claim 10, further including second means, spaced from said first transporting means, for transporting the developer material closely adjacent to the photoconductive surface so that the toner particles are attracted from the carrier granules to the image region forming a toner powder image thereon.

12. A printing machine according to claim 11, wherein said second transporting means includes:

a second magnetic member; and a second non-magnetic tubular member.

13. A printing machine according to claim 10, wherein the charge on the photoconductive surface induces a charge on said first transporting means that biases said first transporting means to a floating constant electrical bias.

14. A printing machine according to claim 13, further including means for limiting the upper and lower values of the constant electrical bias applied on said first transporting means.

* * * * *